US008477009B2

(12) United States Patent
Baucom

(10) Patent No.: US 8,477,009 B2
(45) Date of Patent: Jul. 2, 2013

(54) ASSET SECURITY SYSTEM AND ASSOCIATED METHODS FOR SELECTIVELY GRANTING ACCESS

(75) Inventor: L. Stephen Baucom, Mint Hill, NC (US)

(73) Assignee: Marcon International, Inc., Harrisburg, NC (US)

( * ) Notice: Subject to any disclaimer, the term of this patent is extended or adjusted under 35 U.S.C. 154(b) by 175 days.

(21) Appl. No.: 12/692,781

(22) Filed: Jan. 25, 2010

(65) Prior Publication Data

US 2010/0176916 A1 Jul. 15, 2010

Related U.S. Application Data

(63) Continuation-in-part of application No. 11/511,009, filed on Aug. 28, 2006, now Pat. No. 7,656,272.

(60) Provisional application No. 60/712,178, filed on Aug. 28, 2005.

(51) Int. Cl.
*G08B 21/00* (2006.01)

(52) U.S. Cl.
USPC ..... 340/5.52; 340/5.82; 340/5.73; 273/236; 273/309; 463/29

(58) Field of Classification Search
USPC ..... 340/5.52, 5.82; 273/236, 309; 463/29
See application file for complete search history.

(56) References Cited

U.S. PATENT DOCUMENTS

| | | | | |
|---|---|---|---|---|
| 5,923,249 | A * | 7/1999 | Muir | 340/545.1 |
| 6,945,870 | B2 * | 9/2005 | Gatto et al. | 463/29 |
| 2002/0173352 | A1 * | 11/2002 | Oliveras | 463/13 |
| 2004/0252030 | A1 * | 12/2004 | Trimble et al. | 340/825.36 |
| 2005/0077995 | A1 * | 4/2005 | Paulsen et al. | 340/5.6 |
| 2005/0215325 | A1 * | 9/2005 | Nguyen et al. | 463/46 |
| 2006/0084502 | A1 * | 4/2006 | Downs et al. | 463/29 |
| 2006/0264252 | A1 * | 11/2006 | White et al. | 463/13 |

* cited by examiner

*Primary Examiner* — Mohammad Ghayour
*Assistant Examiner* — Mark Rushing
(74) *Attorney, Agent, or Firm* — Clements Bernard PLLC; Christopher L. Bernard; Lawrence A. Baratta, Jr.

(57) ABSTRACT

An automated asset management and security system for providing selective authorized access to an asset disposed within or associated with a remotely located lockable device, including: a control console, including: a processor executing one or more algorithms operable for identifying a user, authorizing a predetermined level of access based upon the identity of the user, receiving a command from the user to provide access to the asset disposed within or associated with the remotely located lockable device, and generating a corresponding command for the lockable device; and a communications channel for delivering the corresponding command to the lockable device; wherein the lockable device includes: a controller having a unique address executing one or more algorithms for implementing the corresponding command; and an actuation mechanism operable for selectively providing access to the asset disposed within or associated with the lockable device responsive to the corresponding command.

6 Claims, 7 Drawing Sheets

ASSET SECURITY SYSTEM AND ASSOCIATED METHODS FOR SELECTIVELY GRANTING ACCESS

CROSS-REFERENCE TO RELATED APPLICATION(S)

The present non-provisional patent application/patent is a continuation-in-part of U.S. patent application Ser. No. 11/511,009, filed on Aug. 28, 2006 now U.S. Pat. No. 7,656,272, and entitled "GAMING SECURITY SYSTEM AND ASSOCIATED METHODS FOR SELECTIVELY GRANTING ACCESS," which claims the benefit of priority of U.S. Provisional Patent Application No. 60/712,178, filed on Aug. 28, 2005, and entitled "GAMING SECURITY SYSTEM AND ASSOCIATED METHODS FOR SELECTIVELY GRANTING ACCESS," the contents of both of which are incorporated in full by reference herein.

FIELD OF THE INVENTION

The present invention relates generally to the gaming, asset management, and security fields. More specifically, the present invention relates to an automated keyless asset management system for using in the gaming field, for example, that provides selective authorized access to an asset disposed within a lockable container, and associated methods for selectively authorizing and providing such access. The automated keyless asset management system of the present invention may be used to selectively provide authorized dealer access to a tray of chips, technician access to the interior of a slot machine, or the like, and finds similar applicability in a wide range of industries.

BACKGROUND OF THE INVENTION

Asset management and security are of paramount importance in the gaming field. Casinos must continually control the access to and account for large sums of money in the form of cash, chips, and the like. This task is made difficult by the large number of people who must necessarily have access to and handle the cash, chips, and the like, such as dealers, transportation personnel, back room personnel, and the like. For example, it is a common practice in the gaming field to utilize tables, such as blackjack tables, craps tables, roulette tables, and the like, that are each equipped with a container for holding cash and a tray for holding chips. This chip tray, for example, is typically covered by a lockable glass, metal, or plastic lid. The chip tray is selectively secured to the table, thereby securing the chips to the table. A security lapse could potentially result in the loss of tens of thousands of dollars or more. To deter theft, the personnel who are responsible for the handling and movement of money (e.g. cash, chips, etc.) are continually observed and required to generate reports detailing their actions and the actions of their coworkers, thereby providing a record of who did what and when. The reports enable management to cross check the flow of, access to, and people having responsibility for money. The more comprehensive the reports, the greater the utility and deterrent effect they have. The cost in man-hours to generate and compile the reports is a limiting factor. By way of example, a pit boss in a casino is responsible for the operation of multiple gambling tables—anywhere from 1 to 20 tables. If a table is closed, the chips are typically secured in a chip tray with the lid locked. The chip tray is monitored by overhead cameras. Most lids, while serving as a deterrent, are not designed to be impenetrable. When a dealer needs to gain access to the chips, he or she must request a manager (i.e. the pit boss or the like) to open up a table. The pit boss typically goes to a control room for a key to unlock and remove the chip tray lid. Before taking possession of the key, the pit boss must sign the key out. The pit boss is usually escorted by a guard and a second security person or another manager when taking the key to the table. The dealer is present so that, once access to the chips is provided, he or she may start the game, and the dealer needs to view the contents of the chip tray when it is opened to know the value of the chips in the tray. Typically, the pit boss then returns the key to the control room, where it is signed back in and secured. Again, the pit boss is accompanied by one or more security personnel to ensure the safe return of the key. Typically, the key is unique or one of a very few, and if the key is missing, casino security protocol assumes that the key has been duplicated, and dictates that all of the chip tray locks must be changed. Replacing the locks is expensive, in part because of the cost of the lock, and in part because of the potential disruption to business. All chip trays accessible by the key are vulnerable, and the mindset of a casino is that if one key has been stolen, then the locks on all of the chip trays should be changed.

Thus, what is needed in the art is an automated keyless asset management system that provides comparable or greater security than conventional manual key-based asset management systems. Further, what is needed in the art is an automated keyless asset management system that monitors the status of an asset and its container (e.g. whether access to an asset has been granted or whether it is secured). Additionally desirable would be a system that selectively grants authorized access to an asset, maintains a log of who initiates a request to access the asset, tracks when the asset is secured and unsecured, and the like. The system should also generate reports detailing the actions of the personnel who deal with an asset when it is secured or unsecured, and a historical record of the status of the asset over a specified period of time. In addition to maintaining comparable or greater security than conventional manual key-based asset management systems, the automated keyless asset management system should also retrofit existing chip trays and tables, for example, and be substantially invisible to players—with no visible change in the layout of conventional gaming tables. The system must be robust, in that it is reliable and cost effective, and be compatible with a conventional manual key management system, such that a chip tray may still be opened by a key, for example.

BRIEF SUMMARY OF THE INVENTION

In various exemplary embodiments, the present invention provides an electronic asset security system and associated methods for selectively granting keyless access to a lockable device containing or associated with an asset, for example to a tray of chips attached to a gaming table, a slot machine, or the like; tracking when and to whom access is granted; automating access; monitoring the status of the lockable device and issuing alerts when the lockable device is not secured; establishing levels of security profiles for the lockable device, and generating reports that recap the history of access and the security status of the lockable device.

The keyless asset management system for automating selective access to a lockable device of the present invention includes a command kiosk providing a means to remotely manage multiple lockable devices and a security assembly that is the remote device, wherein the remote device is proximate to the lockable device and provides a means to lock or unlock the lockable device. The command kiosk includes, for example, a touch screen personal computer having a processor executing one or more algorithms operable for identifying a user, authorizing a predetermined level of command control based upon the identity of the user, receiving a command from the user to provide access to the lockable device to the user and a third party, generating and translating the command into a form that may be received by a remote device, wherein there is at least one remote device; a radio frequency transceiver; a biometric scanner for logging the user on to the computer; a keyless asset management system software application with a database program, wherein the application provides a listing and a current status of each lockable device controlled by the command kiosk; and a communications channel operable for communicating the translated command to the remote device. The security assembly comprises a controller having a unique address that has one or more algorithms for translating the communicated command and implementing the translated command; an actuation mechanism actuated by the translated command; one or more switches for detecting if the status of the actuation mechanism is positively locked or positively unlocked or if the status is in an alert condition or otherwise; a reporting algorithm for translating the status into a form that may be received by the command kiosk; a radio frequency transceiver; a housing for mounting and protecting the security assembly; and a communications channel operable for communicating the translated status to the command kiosk. Optionally, the actuation mechanism comprises a solenoid that actuates a latch bar, and the lockable device is a chip tray with a lockable lid disposed over a top of the tray, where said tray is recessed within a surface of a table.

Optionally, the one or more switches for detecting the status of the actuation mechanism is preferably a first micro limit switch that is actuated when the latch bar is actuated. A second micro limit switch is depressed when the lockable lid is correctly positioned over the top of the tray. When the first micro limit switch is actuated and the second micro limit switch is actuated, the status of the chip tray is locked. When the first micro limit switch is not actuated and the second micro limit switch is not actuated and the lid is removed, the status of the chip tray is unlocked. When the first micro limit switch is actuated and the second micro limit switch is not actuated, the status of the chip tray is in an alert condition. When the first micro limit switch is not actuated and the second micro limit switch is actuated, the status of the chip tray is in an alert condition as the lid is on but not locked. The application provides the touch screen with color coded icons indicating the status of whether the chip tray is locked, unlocked, or in the alert condition.

The communications channel of the command kiosk and the communications channel of the security assembly communicate over an encrypted channel, such as a 56-bit dez encryption using frequency hopping spread spectrum radio frequency operating at 900 MHz or the like.

The algorithm authorizing the predetermined level of command control based upon the identity of the user utilizes at least three levels of access, user level, administrator level, and technician level, for example; and the lockable devices have levels of access, wherein the authorizing algorithm only permits an individual who has successfully logged in to change the status of the lockable device, from locked to unlocked or vice versa, and the individual must have as high or higher level of access than the lockable device's access level.

Furthermore, the present invention provides a method for selectively granting access to an asset. The method includes the steps of providing a lockable device coupled to and secured by a security assembly; providing a command kiosk with a processor remotely located from the lockable device executing one or more algorithms operable for identifying a user, authorizing a predetermined level of command control based upon the identity of the user, receiving a command from the user to provide access to the device to at least one of the user and a third party, and translating the command into a form that may be received by the security assembly; providing a communications channel operable for communicating the translated command to the security assembly; providing a controller proximately located to the lockable device executing one or more algorithms operable for actuating the security assembly in response to the translated command, thereby providing access to the lockable device to at least one of the user and a third party; logging in a user with a biometric scanner and confirming against a database of users, where each user has a biometric password and is assigned a level of access; selecting a lockable device and confirming against a database of lockable devices having a unique address and a level of access, that the user has as high or a higher level of access than the selected lockable device; assuming that the user has clearance, selecting at least one third party from a list; actuating a lock on a selected lockable device, or canceling to exit or start the process over; and recording all entries for possible later generation of a report.

It should be noted that the method is particularly suitable as a gaming method for selectively granting access. In such exemplary embodiment, the lockable device is selected from the group consisting of a tray disposed within a surface of a table, an apparatus disposed within a slot machine, and the like. In the case of a tray, there is a lid disposed over a top of the tray coupled with a selectively actuated latch assembly, and in the case of a slot machine there is a door disposed over an opening of the slot machine coupled with the selectively actuated latch assembly. The processor is further operable for receiving a command from the user to prevent access to the device for at least one of the users and a third party and translating the command into a form that may be received by the security assembly. After actuating the actuating a lock, the user is automatically logged out. Alternatively, the security assembly is only actuated temporarily, reverting to an initial state after a predetermined period of time.

In a more broad sense, in one exemplary embodiment, the present invention provides an automated asset management and security system for providing selective authorized access to an asset disposed within or associated with a remotely located lockable device, including: a control console, including: a processor executing one or more algorithms operable for identifying a user, authorizing a predetermined level of access based upon the identity of the user, receiving a command from the user to provide access to the asset disposed within or associated with the remotely located lockable device, and generating a corresponding command for the lockable device; and a communications channel for delivering the corresponding command to the lockable device; wherein the lockable device includes: a controller having a unique address executing one or more algorithms for implementing the corresponding command and implementing the translated command; and an actuation mechanism operable for selectively providing access to the asset disposed within or associated with the remotely located lockable device responsive to the corresponding command. The processor further executes one or more algorithms operable for identifying the user based on acquired biometric data. The processor further executes one or more algorithms operable for recording the identity of the user and the time and nature of the received command. Optionally, the communications channel is a wireless communications channel. Preferably, the lockable device further includes one or more switches operable for detecting the status of the lockable device in terms of whether or not the lockable device is in an access granted, access denied, or alert status. The processor further executes one or more algorithms operable for recording the detected status of the lockable device.

In a more broad sense, in another exemplary embodiment, the present invention provides an automated asset management and security method for providing selective authorized access to an asset disposed within or associated with a remotely located lockable device, including: providing a control console, including: a processor executing one or more algorithms operable for identifying a user, authorizing a predetermined level of access based upon the identity of the user, receiving a command from the user to provide access to the asset disposed within or associated with the remotely located lockable device, and generating a corresponding command for the lockable device; and a communications channel for delivering the corresponding command to the lockable device; wherein the lockable device includes: a controller having a unique address executing one or more algorithms for implementing the corresponding command and implementing the translated command; and an actuation mechanism operable for selectively providing access to the asset disposed within or associated with the remotely located lockable device responsive to the corresponding command. The processor further executes one or more algorithms operable for identifying the user based on acquired biometric data. The processor further executes one or more algorithms operable for recording the identity of the user and the time and nature of the received command. Optionally, the communications channel is a wireless communications channel. Preferably, the lockable device further includes one or more switches operable for detecting the status of the lockable device in terms of whether or not the lockable device is in an access granted, access denied, or alert status. The processor further executes one or more algorithms operable for recording the detected status of the lockable device.

BRIEF DESCRIPTION OF THE DRAWINGS

The present invention is illustrated and described herein with reference to the various drawings, in which like reference numbers are used to denote like system components/method steps, as appropriate, and in which.

DETAILED DESCRIPTION OF THE INVENTION

Figure 2:
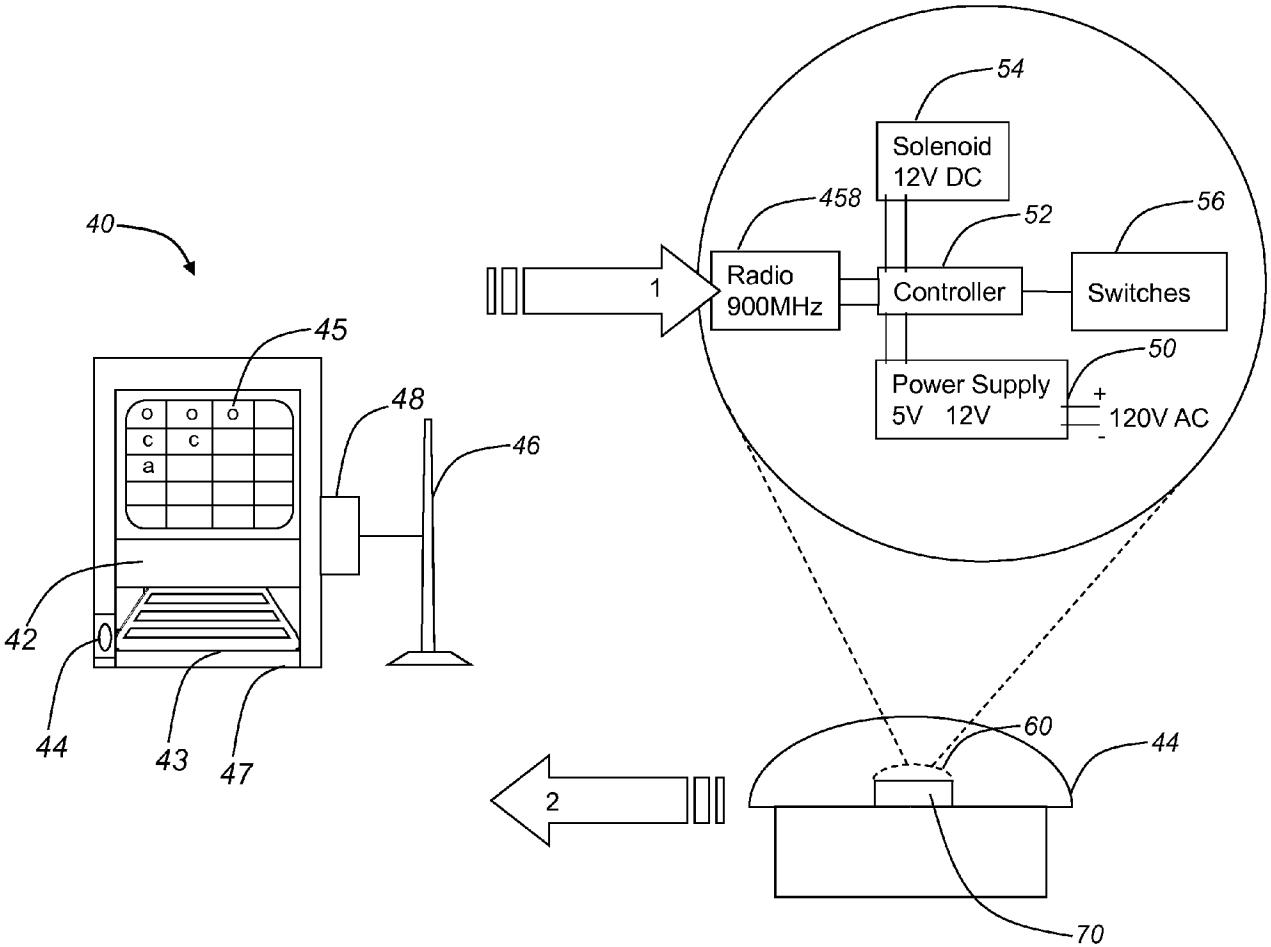
FIG. 2 is a schematic diagram illustrating one exemplary embodiment of the automated keyless asset management security system of the present invention.
Figure 3:
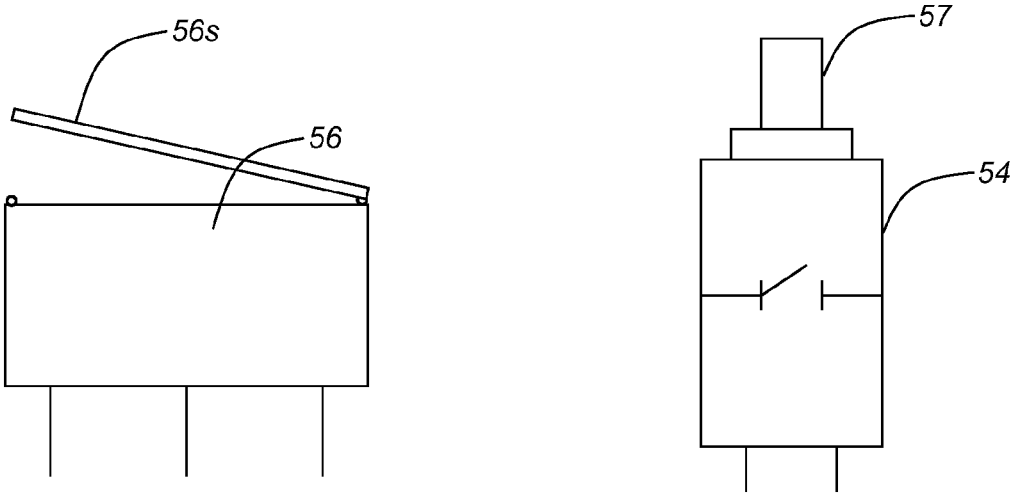
FIG. 3 is a schematic diagram illustrating exemplary embodiments of a number of limit switches associated with and utilized in the automated keyless asset management security system of FIG. 2.
Figure 5:
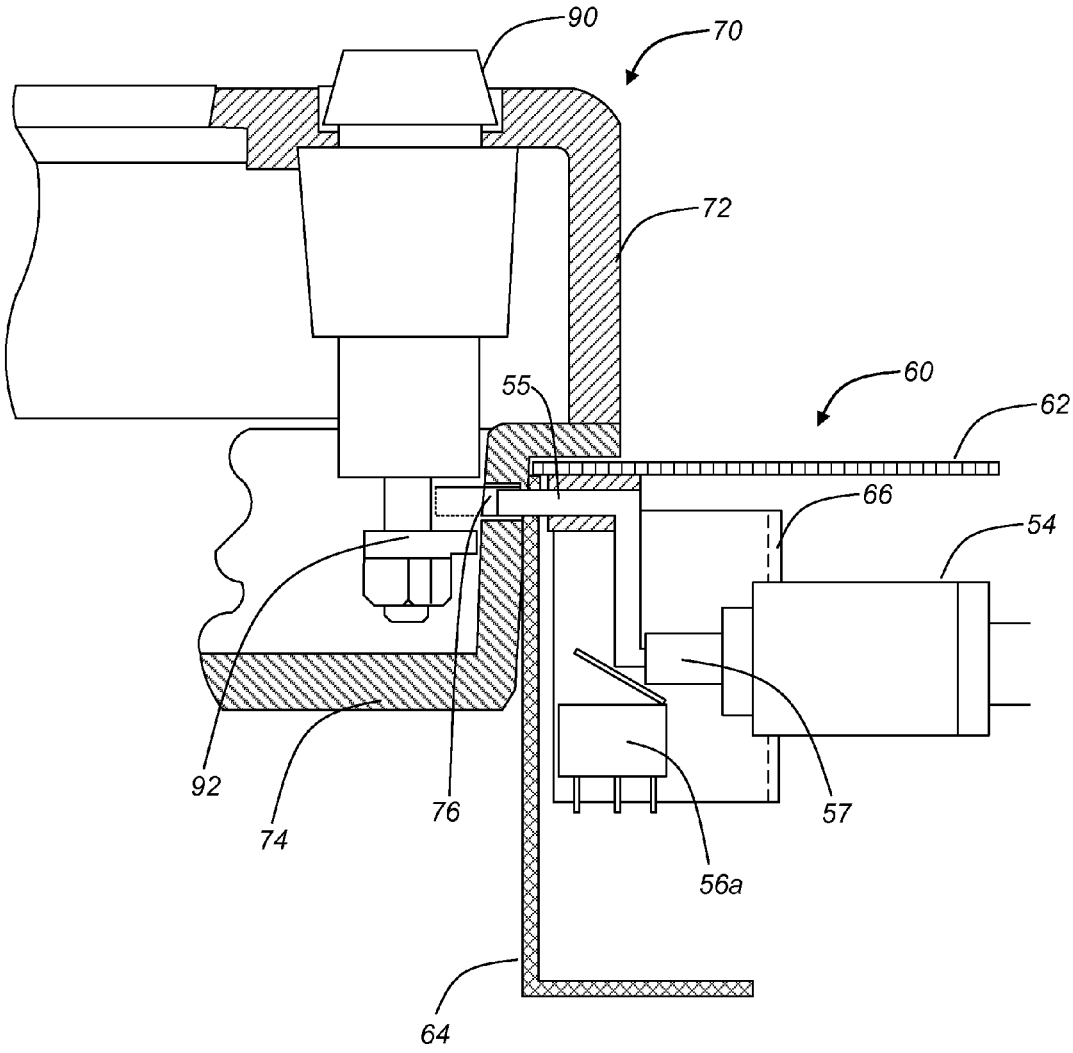
FIG. 5 is a partial cross-sectional view illustrating one exemplary embodiment of a latch assembly configuration associated with and utilized in the automated keyless asset management security system of FIG. 2.

In one exemplary embodiment, the present invention provides a keyless asset management system and method 10 for automating keyless access to a chip tray or other asset container having a lid, optionally with a conventional keyed lock. As illustrated in FIG. 2, the chip tray 70 is secured to a gaming table 80 or the like, and the lid is removed when it is unlocked when the table is opened, for example. In this exemplary embodiment, the system 10 may be fitted to a new key-locked chip tray or retrofitted to an existing key-locked chip tray. The system 10 includes a processor 42 located in a command kiosk 40 for managing access to tables or other entities of interest located in the vicinity, and enables an authorized user to lock or unlock the chip tray 70 or other asset container using the command kiosk 40. The processor 42 sends commands via a radio transceiver 48 with an antenna 46 over a secure communication channel 1, such as a 900 MHz, encrypted FHSS (frequency hopping spread spectrum), to a security assembly 60 located within the gaming table 80. Other wireless or wired communication mediums may also be utilized. The security assembly 60 actuates keyless unlocking and locking of the chip tray 70, and optionally also allows keyed locking and unlocking of the chip tray lid. Typically, the kiosk controls up to 20 tables. The processor 42 has a touch screen 45 or other user interface housed in a cabinet with a lockable drawer 47 containing a keyboard 43, for example, the radio frequency transceiver 48 and attached antenna 46, a biometric scanner 44 or the like for logging on to the computer 42, a keyless management system software application with a database program, an algorithm that provides secure commands to be issued to a designated security assembly 60 having a unique MAC (media access control) address or the like, and a de-encryption algorithm for deciphering information received from the security assembly 60. In one exemplary embodiment, the security assembly 60 electronically controls access to an associated chip tray 70 or the like via a solenoid 54 that actuates a latch bar 55, as shown in FIG. 5. Actuation is effected by a plunger 57. The solenoid is mounted on a bracket 66 attached to the housing 69, or a wall therein. The solenoid and the latch bar comprise an actuated latch assembly. Typically, there is one security assembly 60 and one chip tray 60 per gaming table 80. In a preferred embodiment, the security assembly is recessed in the top of the table, mounted flush with the surface, and covered with felt, for example. The security assembly 60 is not visible when installed, and may only be accessed by removing the felt, for example. The security assembly is compactly sized so that it may easily fit into substantially all conventional gaming tables at a position proximate to the playing area on the table coupled to the chip tray. The chip tray is normally configured so that the lockable lid opens away from a dealer, adjacent to the playing area. FIG. 5 illustrates the security assembly 60 coupled to the chip tray 70. In this exemplary embodiment, a unique feature of the invention arises from the fact that most conventional lockable chip tray lids 72 utilize a cam lock 90 that is actuated with a key (not shown), where the cam lock has a cam that is sufficiently long such that when the cam is rotated, a portion of the cam pivots into a slot 76 in the wall of the chip tray 74, thereby engaging the cam with the tray. In the present invention, the original cam is replaced with a shortened, offset custom cam 92 which is too short to engage the slot. When the custom cam is engaged by the latch bar 55, it is locked. In the locked position, the latch bar projects through the slot overlapping the custom cam, as illustrated by dashed lines. This feature enables the cam lock 90 to be locked and unlocked with a key when the latch bar 55 is in the locked position. In the present invention, the custom cam 92 serves as the engaged element, rather than its traditional role as the engaging element. As shown in FIG. 2, the security assembly also includes sensors, typically micro limit switches, which detect the position of the latch bar (locked or unlocked), and the lid (whether it is on or off). As can be seen in FIG. 2, the security assembly 60 has a controller 52 with a transceiver 58 to receive the encrypted commands 1 issued by the processor 42, an algorithm to de-encrypt the commands, and a digital-to-analog interface to actuate the solenoid 54. The controller regularly transmits encrypted status information 2 to the command kiosk 40. The status information includes a time stamp, the position of the latch bar (locked or unlocked), and the lid (on or off) as determined by the sensors (i.e. limit switches 56). Status updates are typically sent 10 times a second or more frequently. The information is encrypted with an encryption algorithm compatible with the processor's de-encryption algorithm.

The keyless management system software application provides a method for remotely managing the chip tray and the like, a means of selectively granting access, a means of maintaining a log of who initiates a request to access the chip tray, and a means of monitoring if the chip tray lid is unlocked or locked and if the lid is removed or replaced or otherwise tampered with. The application logs the activity in a database for reports detailing the actions of the personnel who were present when a chip tray is locked or unlocked, creates a historical record of the status of the chip tray over a specified period of time, and authorizes a predetermined level of command control based upon the identity of the user, maintains a profile of the tables where each table has a name, a MAC address, and a security level for access to the table; and a profile of the users, where each user has a personal security level for access and a means of verifying their identity such as a personal password, a written signature, a biometric signature such as a finger print scan, a retinal scan, and the like. The user may only access tables where the user has a higher level of security clearance than the security level for access for the table. There are optimally three types of users, a manager such as a pit boss, an administrator, and a technician. The access level is substantially determined by the need to perform their job. A manager who is running the tables need not necessarily have security clearance to add or delete tables, or add or delete personnel, or change the security level for personal. An administrator on the other hand would need this level of access, and would have a higher level of security. A technician working on the processor would need to have access to files and scripts and would usually require the highest level of security, possibly at periodic intervals.

Figure 4:
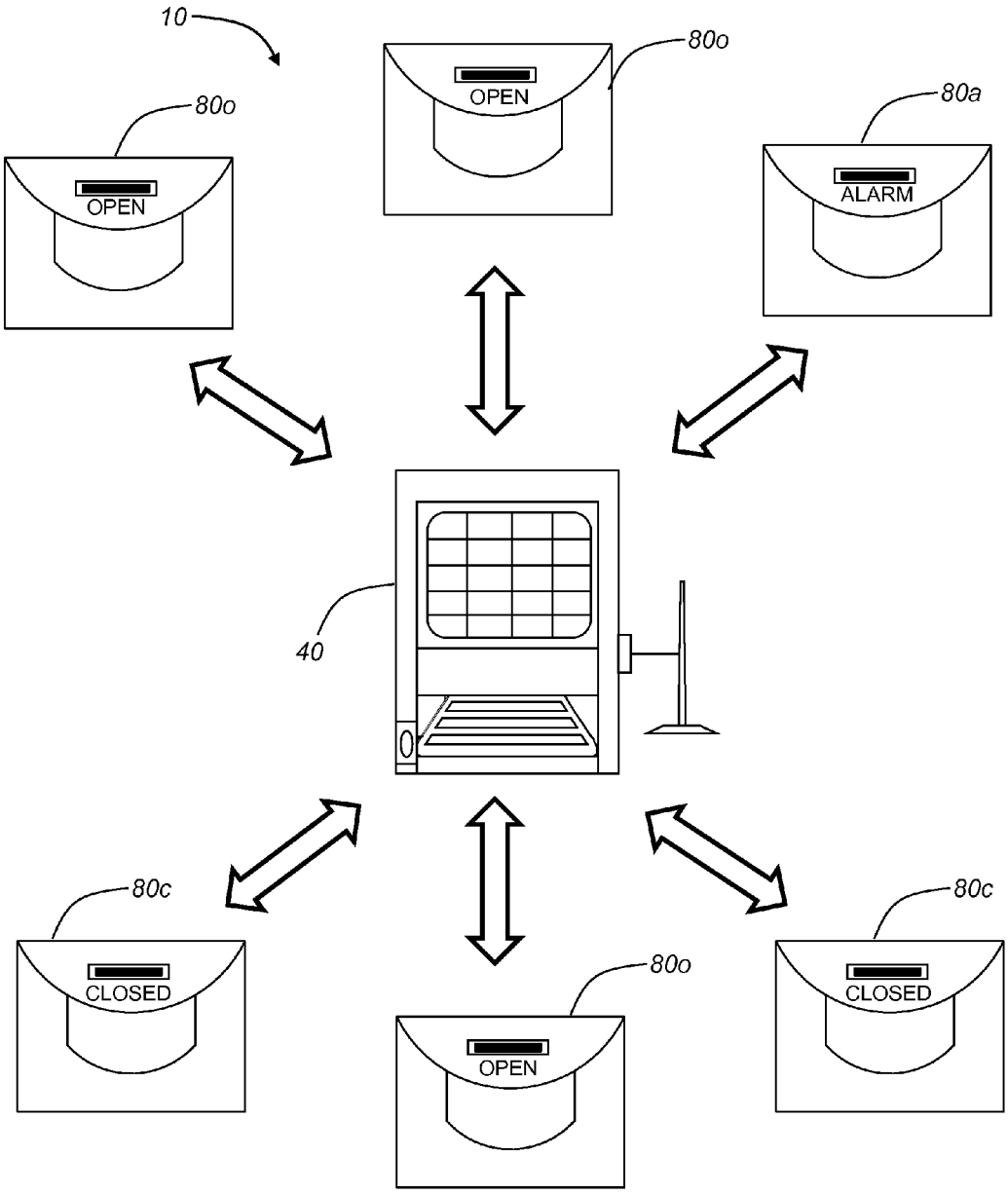
FIG. 4 is a schematic diagram illustrating a command kiosk controlling six gaming tables in accordance with the systems and methods of the present invention.
Figure 6A:
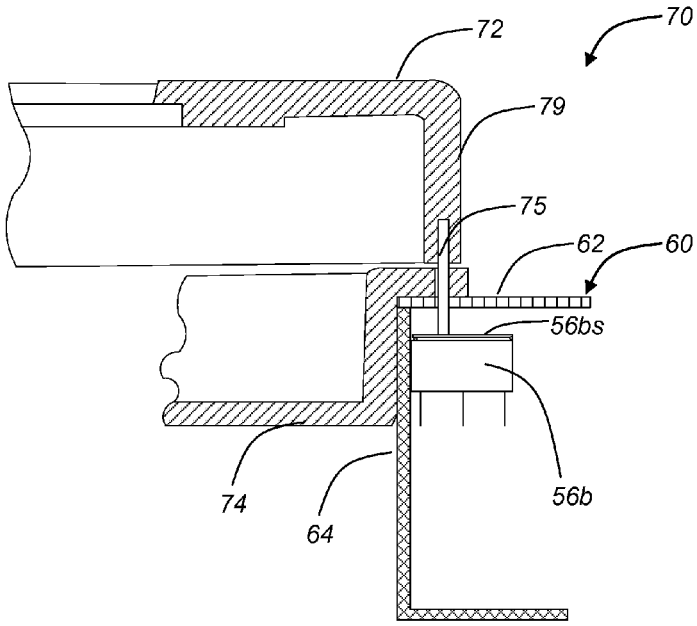
FIGS. 6*a* and 6*b* are partial cross-sectional views illustrating one exemplary embodiment of a chip tray lid limit switch assembly associated with and utilized in the automated keyless asset management security system of FIG. 2.
Figure 6B:
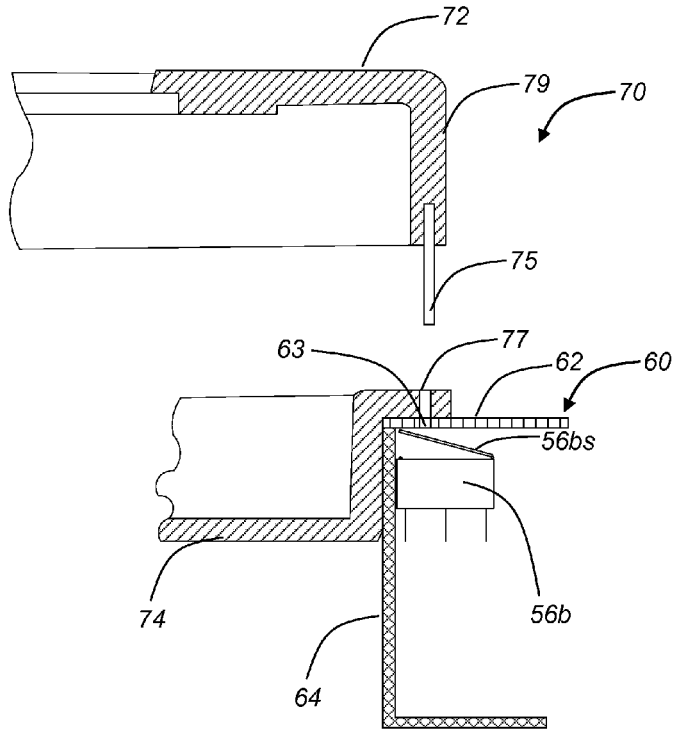
Figure 7:
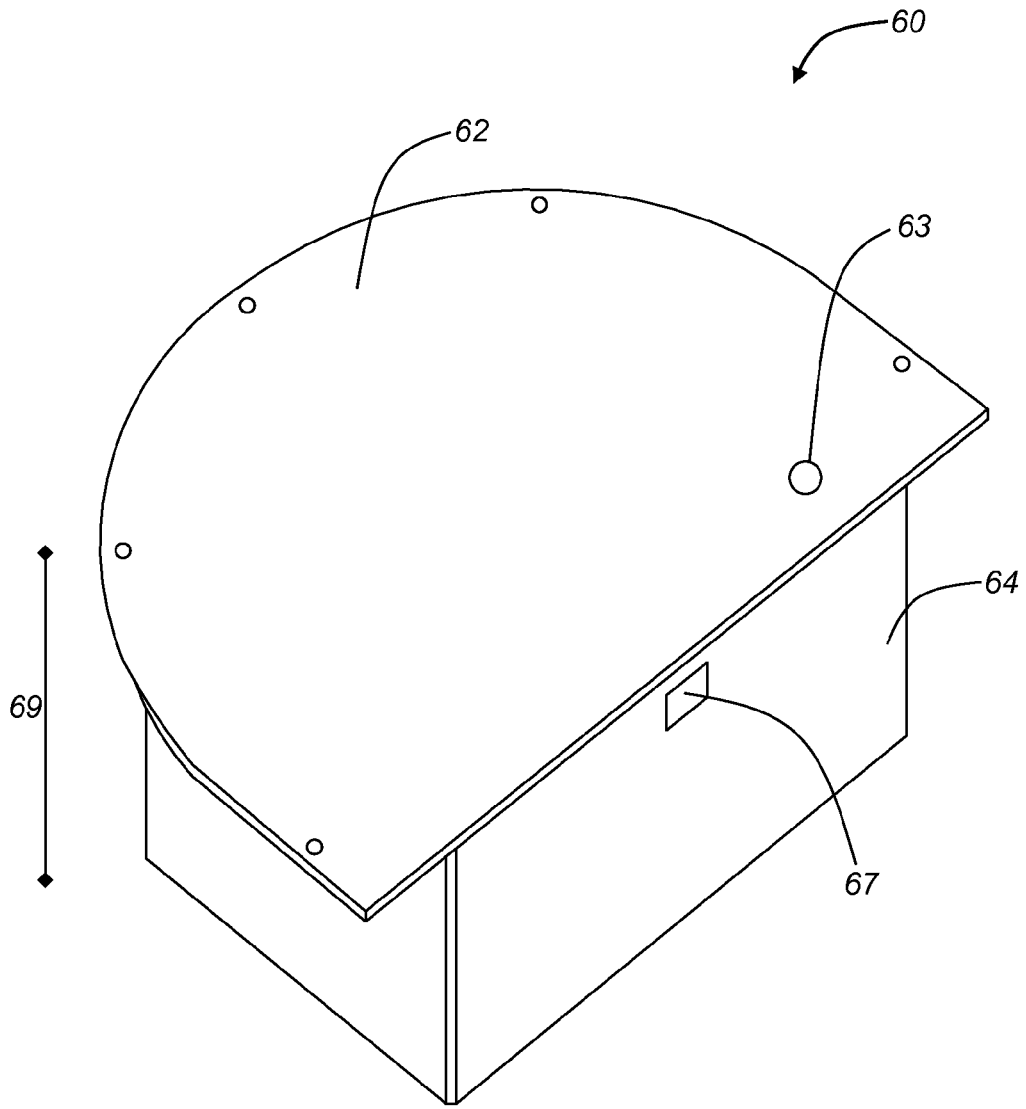
FIG. 7 is a perspective view illustrating one exemplary embodiment of a housing of a security assembly of a gaming table associated with and utilized in the automated keyless asset management security system of FIG. 2.

Referring to FIG. 4, the command kiosk 40 of the keyless management system 10 displays a touch screen with a matrix of icons, diagrammatically represented by dashed cross-hatching, that simulate the tables 80. The touch screen provides an easy to read visible representation of each of the tables. The icons are color coded to indicate their status. For instance, a gaming table that has a closed chip tray is yellow 80*c*, a table that is open is green 80*o*, and a table where there is a security issue is red 80*a*. The touch screen 45 as illustrated in FIG. 2, has letters "o", "c", and "a" combined with the number 80, where the letters respectfully designated whether the tables are open, closed, or have a security issue and are on status alert. Examples of security issues include when the lid 72 is on but not locked, and when the lid 72 is off but the latch bar 55 is in the lock position. FIGS. 5 and 6 illustrate how the status of the chip tray is determined. Referring to FIG. 5, when the chip tray is unlocked, the limit switch 56*a* is "open", and when it is locked the plunger 57 changes the limit switch 56*a* to the "closed" position. The latch bar 55, which emerges from the wall 64 through opening 67 of the housing 69 as shown in FIG. 7, is pushed through the slot 76 of the chip tray 74, and engages the custom cam of the cam lock 90, which is in the chip tray lid 72. Furthermore, as shown in FIGS. 6*a* and 6*b*, when the lid 72 is fitted on the tray 74, which has a pin 75 which projects from the sidewall 79 of the lid 72. When properly positioned, the pin penetrates an opening 77 in the flanged top of the tray, and projects through access hole 63 in the top 62 of the housing 69 of the security assembly 60. The pin 74 presses down on the limit switch sensor 56*b*, such that the switch sensor 56*b* is "closed". If the pin 75 is not depressing the sensor, then the lid 72 is either not on or is improperly aligned, and the latch bar 55 may not engage the custom cam 92, and the lid is "open". This would constitute an alert status and the touch screen would reflect this by the color of the icon, or as shown in FIG. 2 the letter "a". An alarm may also issue, or any other variety of signals. Any change in the status of the switches not initiated by the command kiosk, for instance by tampering, is quickly detected, as the controller sends back the status updates multiple times per second.

In one exemplary embodiment, after logging in, by touching the icon on the screen, a user or administrator or technician may initiate a request to change the status of the table. For instance, if a pit boss wants to open a table, he or she would login, using the biometric finger print scanner that converts the scan to a digital numeric representation and compares the digital numeric representation to one that is on file in the database confirming that the user is an authorized user. When the user selects a table, the processor confirms that the user is has security clearance to access to the table. Assuming that the user has clearance, the application brings up a window of responsible parties from three lists. Responsible parties are for example administrators, dealers, and security. The user selects an individual from each of the three lists, and then touches "open" to unlatch the lid, or "cancel" to exit or start the process over. Typically, after the table is opened or closed, the user is automatically logged out. Log out can also be set to automatic after a certain period of time. All the information is collected in a database. The database may be configured with roles, such as user, administrator, or technician. The different roles have default security clearance levels, but with proper authority the roles, and individual users, may be granted higher or lower levels of security, or may have triggers that initiate other sequences when a user logs on. For example, a user could be earmarked to be monitored by additional cameras when the user logs on. An administrator may add or delete tables or users at the kiosk. Again, using the touch screen, the administrator may bring up a menu to add the user, assign a level of security, and then scan in the biometric password. Similarly, when a table is added, it is assigned a name, a MAC address, and a security level. The technician role typically has authority to do all.

Figure 1:
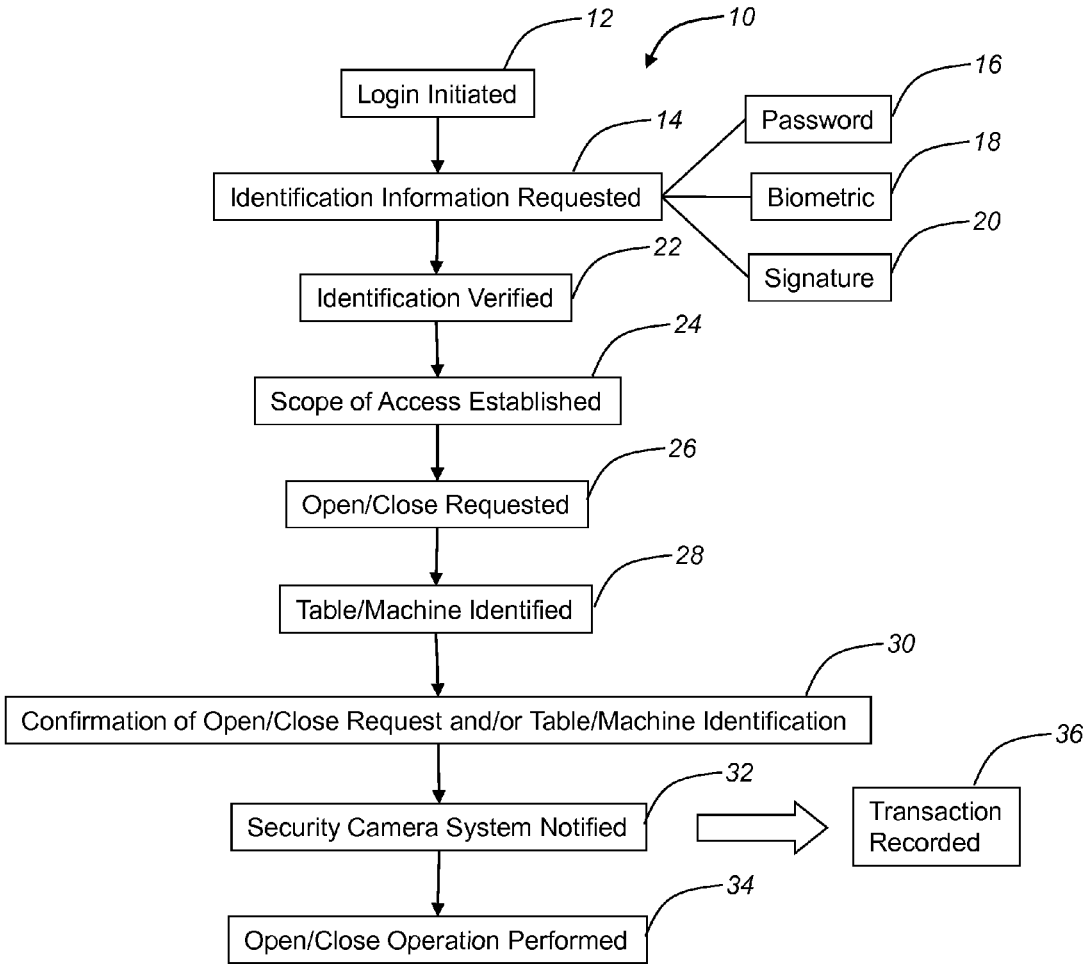
FIG. 1 is a flowchart illustrating one exemplary embodiment of the automated method for selectively granting access to an asset of the present invention.

Referring to FIG. 1, is a flowchart illustrating an embodiment of the method for selectively granting access to an asset, such as dealer access to a tray of chips at a table, technician access to the interior of a slot machine, or the like, of the present invention. The invention 10 is a method for selectively granting access, such as dealer access to a tray of chips at a table, technician access to the interior of a slot machine, or the like providing a keypad and display, touch screen, or the like suitable for displaying a number of menus, screens, and the like to a user, including a login screen. For purposes of this exemplary embodiment, the user is a manager (i.e. a pit boss or the like). The user initiates the login by pressing a button, making a selection, or the like (Block 12) and the system requests identification information from the user (Block 14). This identification information includes, for example, a user identification number/password 16, biometric information 18 (such as a fingerprint, retinal, or voice scan), and/or a signature 20 (entered via an electronic signature pad or the like). Using the identification information, the user's identification is verified (Block 22) and the permitted scope of the user's access (authorization level) is established (Block 24).

Once the user identification/authorization process is complete, the user makes a task request, such as an open/close request (Block 26). Following this task request, the user makes a table selection, for example, from a list of tables or a schematic diagram illustrating the location of the tables (Block 28). As will be readily apparent to one of ordinary skill in the art, slot machines, or any other items that one wishes to selectively open/close in a secure manner, whether related to the gaming field or not, may be substituted for the tables. Optionally, the tables that may be opened/closed/in an alert state at a given time are highlighted on the list or schematic diagram. Following the initial table selection, the system requests appropriate confirmation (Block 30). Upon confirmation, the system can communicate with the security camera system, allowing the security camera system to focus on and record a series of images of the table selected (Block 32). Finally, the open/close operation is performed (Block 34). Preferably, an audio and/or visual alarm is sounded/flashed during the open/close operation, which may be timed out after a given amount of time (such as 15 seconds, 1 minute, or the like). After the dealer lifts the lid off of the tray in order to open a table, or another comparable operation is performed, a "closed" switch reads "open" to the controller, the actuation mechanism which actually performs the open/close operation returns to a "relaxed" state, and a "locked" switch reads "closed" to the controller. Once the table is opened and the command kiosk receives a signal from the controller indicating that the switches meet the "open" requirements, the user may be logged out by the system. Preferably, data related to all of the above steps is acquired and stored in the database, including, for example, user identification information, date, time, action requested, table and the like (Block 36). When the command kiosk is not being used by a user, the touch screen illustrating the current status of the tables is displayed.

After the dealer puts the lid on the tray in order to close a table, or another comparable operation is performed, the "closed" switch reads "closed" to the controller, the actuation mechanism (i.e. the solenoid), which actually performs the open/close operation returns to a "relaxed" state, and the "locked" switch reads "closed" to the controller. Once the table is closed and the system receives a signal from the controller indicating that the switches meet the "closed" requirements, the user may be logged out by the system.

Preferably, a user that is logged in may complete only one transaction before being logged out in order to guarantee the user's identification and proper authorization. Additionally, the system as a whole may be equipped with a time out feature.

Once the user identification/authorization process is complete, the user selects which table to open/close by touching the corresponding icon on the touch screen. Following this task request, the user makes a table selection, for example, from a list of tables or a schematic diagram illustrating the location of the tables. Accordingly, the gaming security system 40 includes at least one table 44 containing circuitry and hardware operable for receiving an open/close command from the computer 42 and an antenna 46 via a radio frequency signal or the like. Again, as will be readily apparent to one of ordinary skill in the art, slot machines, or any other items that one wishes to selectively open/close in a secure manner, whether related to the gaming field or not, may be substituted for the tables. Optionally, the tables that may be opened/closed at a given time are highlighted on the list or schematic diagram. Following the initial table selection, the system 40 requests appropriate confirmation. Upon confirmation, the system 40 communicates with the security camera system, allowing the security camera system to focus on and record a series of images of the table selected. Finally, the open/close operation is performed. Preferably, an audio and/or visual alarm is sounded/flashed during the open/close operation, which may be timed out after a given amount of time (such as 15 seconds, 1 minute, or the like).

The circuitry and hardware of each of the at least one tables 44 includes a power supply 50, which for safety reasons is converted to a low voltage. Once the table 80 is opened and the command kiosk 40 receives a signal 2 from the controller 52 indicating that the switches 56 meet the "open" requirements, the user may be logged out by the system 10. Preferably, data related to all of the above steps is acquired and stored, including, for example, user identification information, date, time, action requested, table, and the like. When the system 10 is not being used by a user, a schematic diagram illustrating the current status of the tables may be displayed.

In another exemplary embodiment of the present invention, a method for selectively granting access includes providing a device coupled to and secured by a security assembly; providing a processor remotely located from the device executing one or more algorithms operable for identifying a user, authorizing a predetermined level of command control based upon the identity of the user, receiving a command from the user to provide access to the device to at least one of the user and a third party, and translating the command into a form that may be received by the security assembly; providing a communications channel operable for communicating the translated command to the security assembly; and providing a controller proximately located to the device executing one or more algorithms operable for actuating the security assembly in response to the translated command, thereby providing access to the device to at least one of the user and a third party.

Advantageously, the systems and methods of the present invention provide for wireless asset control; multiple users may be provided with multiple degrees of asset access, errors are logged, and an audit trail of users and activities is created, it being possible to generate customizable reports.

Other potential applications of the systems and methods of the present invention include those associated with any/all keyed casino games; any/all keyed asset cabinets, boxes, drawers, etc.; any/all latched and/or keyed devices; and the like.

Although the present invention has been illustrated and described with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

The invention claimed is:

1. An automated asset management and security system for providing selective authorized access to an asset disposed within or associated with a remotely located lockable device, comprising:

a control console, comprising:

a processor executing one or more algorithms operable for identifying a user, authorizing a predetermined level of access for the user based upon the identity of the user, receiving at least one signal confirming a security status of the asset disposed within or associated with the remotely located lockable device, receiving an access request from the user to provide access to the asset disposed within or associated with the remotely located lockable device, confirming the access request from the user according to the predetermined level of access for the user, initiating a recording of visual data regarding the security status of the asset disposed within or associated with the remotely located lockable device, and generating a corresponding command for the lockable device; and a communications channel for delivering the corresponding command to the lockable device;

wherein the lockable device comprises:

a controller having a unique address executing one or more algorithms for implementing the corresponding command;

an actuation mechanism operable for selectively providing access to the asset disposed within or associated with the lockable device responsive to the corresponding command; wherein the lockable device comprises a plurality of gaming tables disposed in different physical locations from one another and from the control console, and wherein the plurality of gaming tables are centrally managed from the control console;

wherein at least one gaming table comprises a tray having a lid;

wherein the actuation mechanism is operable for locking the tray to the gaming table; and wherein the lid comprises a lock operable to be locked and unlocked when the tray is locked to the gaming table.

2. The automated asset management and security system of claim 1, wherein the processor further executes one or more algorithms operable for identifying the user based on acquired biometric data.

3. The automated asset management and security system of claim 1, wherein the processor further executes one or more algorithms operable for recording the identity of the user and the time and nature of the received command.

4. The automated asset management and security system of claim 1, wherein the communications channel comprises a wireless communications channel.

5. The automated asset management and security system of claim 1, wherein the lockable device further comprises one or more switches operable for detecting the status of the lockable device in terms of whether or not the lockable device is in an access granted, access denied, or alert status.

6. The automated asset management and security system of claim 5, wherein the processor further executes one or more algorithms operable for recording the detected status of the lockable device.

* * * * *